US007248275B2

(12) United States Patent
Okitsu

(10) Patent No.: US 7,248,275 B2
(45) Date of Patent: Jul. 24, 2007

(54) THERMAL HEAD INCLUDING SI SUBSTRATE AND METHOD FOR MANUFACTURING THE SAME

(75) Inventor: Sunao Okitsu, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 381 days.

(21) Appl. No.: 11/048,337

(22) Filed: Feb. 1, 2005

(65) Prior Publication Data

US 2005/0174502 A1 Aug. 11, 2005

(30) Foreign Application Priority Data

Feb. 10, 2004 (JP) ..... 2004-032874

(51) Int. Cl.
*B41J 2/335* (2006.01)
*B41J 2/345* (2006.01)

(52) U.S. Cl. ..... 347/208

(58) Field of Classification Search ..... 347/200, 347/205, 208; 438/21
See application file for complete search history.

(56) References Cited

U.S. PATENT DOCUMENTS 4,635,075 A * 1/1987 Grummer et al. ..... 347/201
4,795,887 A * 1/1989 Myokan ..... 219/543
5,148,188 A * 9/1992 Ota et al. ..... 347/208
5,361,086 A * 11/1994 Tagashira ..... 347/205
5,680,170 A * 10/1997 Taniguchi et al. ..... 347/208
6,201,558 B1 3/2001 Shirakawa et al.
6,331,868 B1 * 12/2001 Yamade et al. ..... 347/208

FOREIGN PATENT DOCUMENTS

JP 6-61947 8/1994
JP 10-034991 2/1998

* cited by examiner

*Primary Examiner*—Huan Tran
(74) *Attorney, Agent, or Firm*—Brinks Hofer Gilson & Lione

(57) ABSTRACT

A thermal head includes a heat storage layer disposed on a substrate surface by lamination, a plurality of heating elements disposed on the heat storage layer, a plurality of individual electrodes, each connected individually to one end-portion of a heating element in the length direction of the resistance, and a common electrode electrically connected to the other end-portions of all heating elements in the length direction of the resistance, wherein the above-described substrate is a Si substrate having a resistivity of 20 mΩ·cm or less, the Si substrate is provided with an exposure region including no heat storage layer, and a contact portion is disposed on the exposure region, so as to keep the common electrode and the Si substrate surface in ohmic contact.

14 Claims, 4 Drawing Sheets

THERMAL HEAD INCLUDING SI SUBSTRATE AND METHOD FOR MANUFACTURING THE SAME

This application claims the benefit of priority to Japanese Patent Application No. 2004-032874 filed on Feb. 10, 2004, herein incorporated by reference.

BACKGROUND OF THE INVENTION

1. Field of the Invention

The present invention relates to a thermal head mounted on a thermal transfer printer, for example, and a method for manufacturing the same.

2. Description of the Related Art

A thermal head includes a heat storage layer made of a highly heat-insulating material, a plurality of heating elements which generate heat by energization, a plurality of individual electrodes, each electrically connected individually to one end-portion of a heating element in the length direction of the resistance of the plurality of heating elements, a common electrode electrically connected to the other end-portions of all heating elements, and a protective layer to protect these plurality of heating elements, individual electrodes, and common electrode, on a substrate having excellent heat-dissipating property and made of Si, a ceramic material, or a metallic material, for example. Such a known thermal head performs printing operation by pressing the heating elements against an ink ribbon and a printing substrate wound around a platen roller while the heating elements are generating heat through the common electrode and the individual electrodes.

In recent years, requirements for high output thermal heads capable of performing high-quality printing with higher definition and high-speed printing have been intensified. Therefore, it is indispensable to reduce common drop (drop in voltage of common electrode) and to improve the printing quality. In order to reduce the common drop, the area and the thickness of the common electrode may be increased so as to reduce the common resistance. However, if the common electrode becomes large or thick, achievement of miniaturization becomes difficult. Consequently, up to now, as shown in FIG. 9, an upper common electrode 15 connected to one end-portion of each of a plurality of heating elements 18 is provided and, in addition, a lower common electrode 16 having an area larger than the area of the upper common electrode 15 is provided as a layer located under a resistance layer constituting the plurality of heating elements 18 with an insulating layer 14 therebetween. The upper common electrode 15 and the lower common electrode 16 are electrically connected to each other through a contact hole 14*a* disposed at a specific position and, thereby, a common electrode is provided. By forming the common electrode having a two-layer structure composed of the upper layer and the lower layer as described above, the common resistance can be significantly reduced, and both the reduction of the common drop and the miniaturization of the head can be satisfied (refer to Japanese Examined Patent Application Publication No. 6-61947, Japanese Unexamined Patent Application Publication No. 10-34991, and U.S. Pat. No. 6,201,558).

However, it was made clear that when the common electrode had a two-layer structure composed of the upper layer and the lower layer as described above, layers in between the upper common electrode and the lower common electrode short-circuited frequently and leakage currents occurred. Since the contact hole is used in order to ensure continuity between the upper common electrode and the lower common electrode, there is a problem in that the manufacturing process is complicated.

SUMMARY OF THE INVENTION

The present invention has been made in consideration of the above-described problems. Accordingly, it is an object of the present invention to provide a thermal head, wherein a structure and a manufacturing process are simple, the common drop can be excellently reduced, and high-quality printing can be realized, and to a method for manufacturing the same.

The present invention has been completed based on the findings that the resistivities of Si substrates previously widely used as substrates of thermal heads were able to be reduced by using the doping technology, and when the resistivities were reduced to 20 mΩ·cm or less, the Si substrates were able to be used as part of the common electrodes.

According to an aspect of the present invention, a thermal head includes a heat storage layer disposed on a substrate surface by lamination, a plurality of heating elements disposed on the heat storage layer, individual electrodes, each electrically connected individually to one end-portion of a heating element in the length direction of the resistance, and a common electrode electrically connected to the other end-portions of all heating elements in the length direction of the resistance, wherein the substrate is a Si substrate having a resistivity of 20 mΩ·cm or less, the Si substrate is provided with an exposure region including no heat storage layer, and a contact portion is disposed on the exposure region, so as to keep the common electrode and the Si substrate surface in ohmic contact.

According to another aspect of the present invention, a method for manufacturing a thermal head includes the steps of preparing a Si substrate having a resistivity of 20 mΩ·cm or less; forming a heat storage layer all over the Si substrate surface; removing a part of the heat storage layer disposed on the Si substrate to form an exposure region and to determine the sectional shape of the heat storage layer adjacent to the exposure region; forming a plurality of heating elements, a common electrode connected commonly to one end-portion of each of the plural heating elements in the length direction of the resistance, and a plurality of individual electrodes, each connected individually to the other end-portion of a heating element in the length direction of the resistance, on the heat storage layer; and forming a contact portion on the exposure region, the contact portion being in contact with an end portion of the common electrode on the exposure region side, so as to keep the common electrode and the Si substrate surface in ohmic contact.

In the above-described aspects, the contact portion may be formed integrally with the common electrode or be formed separately. In the case where the contact portion and the common electrode are disposed separately, the contact portion is formed to come into contact with or be overlaid on an end portion of the common electrode on the exposure region side.

More preferably, the resistivity of the Si substrate is 1.0 mΩ·cm or less.

It is practical that a p-type Si substrate doped with impurities is used as the Si substrate having a resistivity of 20 mΩ·cm or less. For example, in the case of doping of boron as an impurity, the amount of doping of boron is about $10^{17}$ to $10^{19}$ per $cm^3$. Preferably, the contact portion is formed from any one of Cr, Al, Ti, W, Mo, Nb, and Cu or an alloy material primarily containing Cr, Al, Ti, W, Mo, Nb, or Cu in order to attain excellent adhesion to the Si substrate. In consideration of the adhesion to the contact portion, the resistivity (the amount of doping of impurities), and the like, either p-type Si substrate or n-type Si substrate can be selected appropriately.

Preferably, insulating films are disposed on the back of the Si substrate and the circumferential end surface of the Si substrate in the thickness direction. Since a current is passed through the Si substrate via the contact portion, when the common electrode side is set to be hot and the individual electrode side is set to be GND (ground), the Si substrate must be reliably insulated. Conversely, when the common electrode side is GND and the individual electrode side is hot, no insulating film may be disposed on the back of the Si substrate and the circumferential end surface of the Si substrate in the thickness direction. The insulating film may be formed from a sputtering film made of an insulating material, e.g., $SiO_2$, SiAlON, or SiON, a Si anodic oxidation film produced by anodic oxidization, or a thermal oxidation film. In particular, when the insulating film disposed on the circumferential end surface of the Si substrate in the thickness direction is formed from the Si anodic oxidation film, the manufacturing process is readily performed.

Insulating films may be disposed on and under the heat storage layer.

A plurality of head structures may be formed simultaneously on the Si substrate. That is, the Si substrate surface is virtually divided to set parallel-arranged plural head-forming regions, each of the layers from the heat storage layer to the contact portion is formed on a head-forming region basis, and the Si substrate is cut into individual head-forming regions, so that individual thermal heads are produced. Preferably, an insulating film is formed by Si anodic oxidization on each of the cut surfaces of the resulting thermal heads.

In order to set the sectional shapes of a first insulating layer and the heat storage layer, preferably, a resist layer having a uniform film thickness is formed on a part of the heat storage layer to provide a height difference from the heat storage layer, the sectional shape of the resist layer is determined by resist bake and, thereafter, the resist layer and the heat storage layer are subjected to dry etching until this resist layer is completely removed. In this manner, the sectional shape of the heat storage layer is set to be a sectional shape corresponding to the sectional shape of the resist layer determined by the resist bake. More specifically, preferably, the heat storage layer is formed on the Si substrate as a convex portion including a uniform film thickness portion to provide a height difference from the Si substrate surface and a taper edge portion having a film thickness gradually increasing from the Si substrate surface toward the uniform film thickness portion. In this case, the common electrode is located above the taper edge portion. Preferably, insulating films are formed on and under the heat storage layer, if necessary.

According to the present invention, a thermal head can be provided, wherein a structure and a manufacturing process are simple, the common drop can be excellently reduced, and high-quality printing can be realized, and a method for manufacturing the same can be provided.

DESCRIPTION OF THE PREFERRED EMBODIMENTS

Figure 1:
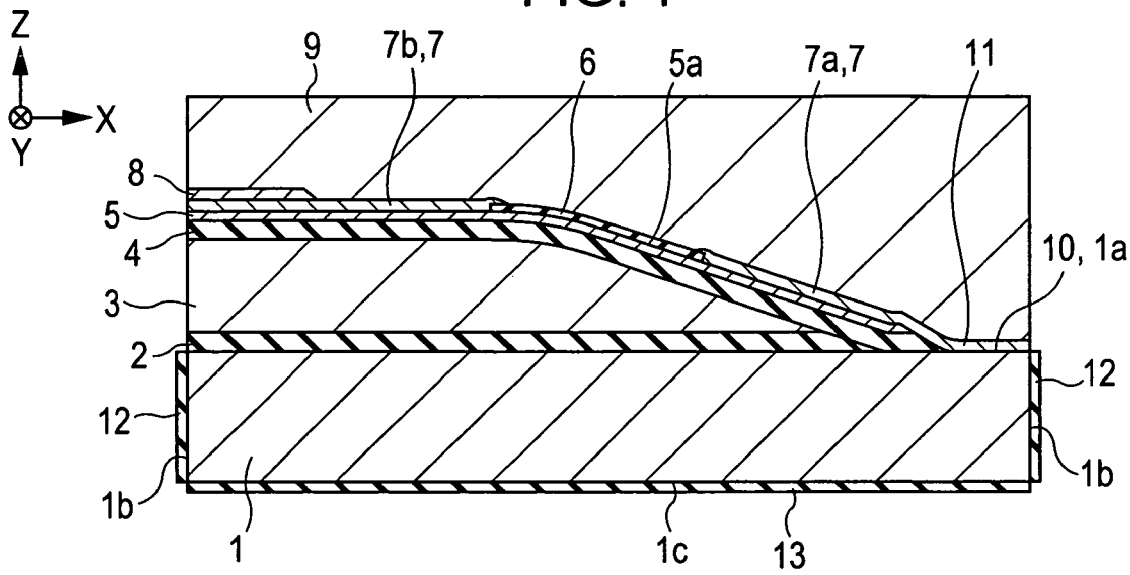
FIG. 1 is a sectional view showing a thermal head according to an embodiment of the present invention.
Figure 2:
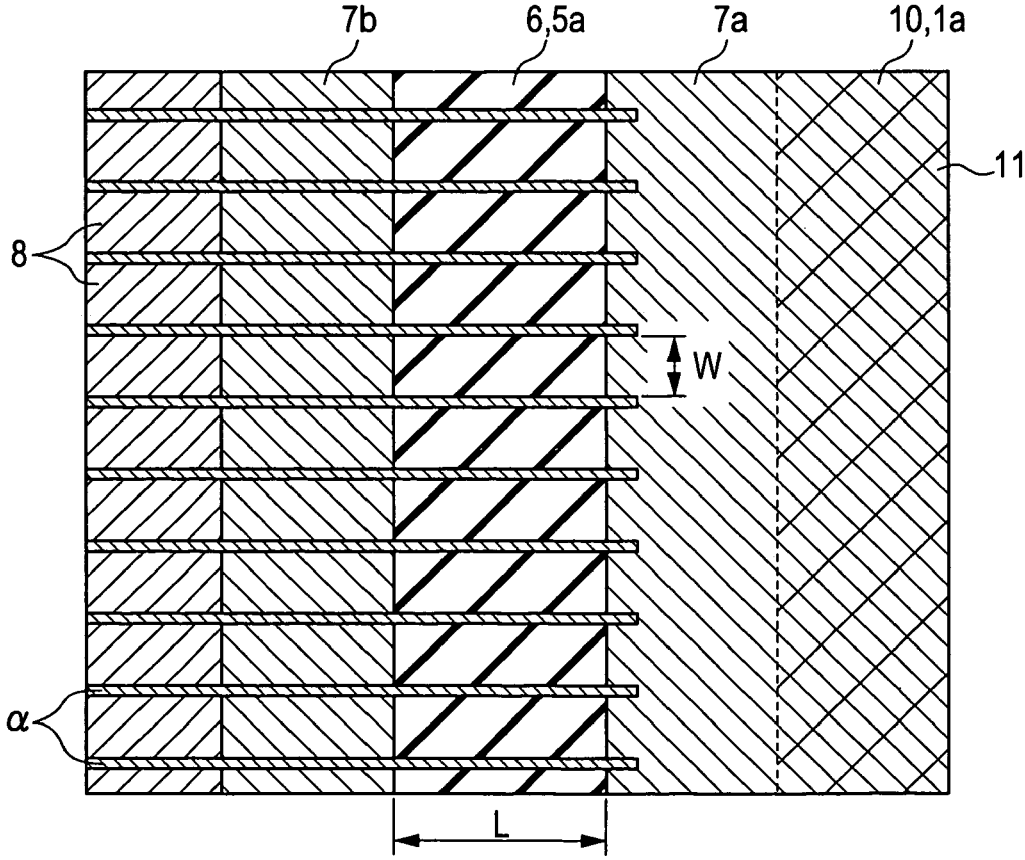
FIG. 2 is a plan view showing the thermal head (in the state before an abrasion-resistant protective layer is formed) shown in FIG. 1.

FIG. 1 and FIG. 2 are a sectional view and a plan view (in the state before an abrasion-resistant protective layer is formed), respectively, showing a thermal head according to an embodiment of the present invention. The present thermal head is provided with a first insulating layer 2, a heat storage layer 3, a second insulating layer 4, a plurality of heating elements 5*a* which generate heat by energization, an insulating barrier layer 6 covering the surface of each heating element 5*a*, an electrode layer 7 electrically connected to two end portions of the plurality of heating elements 5*a* in the length direction of the resistance, and an abrasion-resistant protective layer 9 to protect the plurality of heating elements 5*a*, the insulating barrier layer 6, and the electrode layer 7 from contact with the ink ribbon and the like, on a Si substrate 1 having excellent heat-dissipating property. This thermal head is mounted on a thermal transfer printer, for example, and performs printing by applying heat generated from each heating element 5*a* to thermal paper or an ink ribbon. Although not shown in the drawing, the present thermal head is also provided with a driving IC, a printed circuit board, and the like to control energization of the plurality of heating element portions 5*a*.

The Si substrate 1 is a p-type Si substrate doped with about $10^{17}$ to $10^{19}$ per $cm^3$ of boron as an impurity. This Si substrate 1 has a resistivity of 20 mΩ·cm or less, and preferably of 1.0 mΩ·cm or less. Therefore, a current tends to be readily passed compared with a Si substrate containing no impurity or small amounts of impurities. Insulating layers 12 and 13 are disposed on the side end surface (circumferential end surface in the thickness direction) 1*b* and the back 1*c*, respectively, of the Si substrate 1. The electrical insulation of the Si substrate 1 is adequately ensured by these insulating layers 12 and 13. The insulating films 12 and 13 may be formed from a sputtering film made of an insulating material, e.g., $SiO_2$, SiAlON, or SiON, an anodic oxidation film produced by Si anodic oxidization, or a thermal oxidation film.

The heat storage layer 3 is made of Si, at least one selected from transition metals, and an oxidized compound containing $O_2$. The heat storage layer 3 has a heat-resistant temperature of about 1,000° C. and, therefore, has high heat resistance. Specifically, the transition metal contained in the heat storage layer 3 is at least one selected from Ta, Ti, Cr, Mn, Fe, Co, Ni, Cu, Y, Zr, Nb, Mo, La, Ce, Hf, and W. In particular, preferably, Ta, Mo, or W is used alone or in combination with other transition metals. This heat storage layer 3 is formed on a part of the Si substrate surface 1*a* as a convex portion including a uniform film thickness portion 3*a* to provide a height difference from the Si substrate surface 1*a* and a taper edge portion 3*b* having a film thickness gradually increasing from the Si substrate surface 1*a* toward the uniform film thickness portion 3*a*. If necessary, the first insulating layer 2 and the second insulating layer 4 made of $SiO_2$, for example, are formed on and under the heat storage layer 3, respectively. The plurality of heating element portions 5*a* arranged having infinitesimal spacing in the Y direction (the direction perpendicular to the drawing, FIG. 1) are disposed above the taper edge portion 3*b* of the heat storage layer 3 with the second insulating layer 4 therebetween. The electrical insulation between the Si substrate surface 1*a* and the heat storage layer 3 and the electrical insulation between the heat storage layer 3 and the plurality of heating elements 5*a* are ensured by the first insulating layer 2 and the second insulating layer 4, respectively.

The plurality of heating elements 5*a* are part of the resistance layer 5 disposed on the second insulating layer 4, and are located above the taper edge portion 3*b* of the heat storage layer 3, so as to generate heat by energization. The insulating barrier layer 6 is disposed covering the surface of each heating element 5*a* and determine the two-dimensional size (dot length L, dot width W) of each heating element 5*a*. A gap region a is disposed between adjacent heating elements 5*a*, and in the present embodiment, the insulating barrier layer 6 practically determines the dot length L. The resistance value of each heating element 5*a*, that is, one dot resistance value, is determined by (sheet resistance value of resistance layer 5)×(aspect ratio (L/W)). The insulating barrier layers 6 have the function of preventing surface oxidation of the plurality of heating elements 5*a* and the function of protecting the plurality of heating elements 5*a* from etching damage during the manufacturing process.

The electrode layer 7 is disposed by forming a film all over the resistance layer 5 and the insulating barrier layers 6 and, thereafter, providing opening portions 7*c* to expose the insulating barrier layers 6, and two end portions of the electrode layer 7 on the insulating barrier layer 6 side are overlaid on the insulating barrier layer 6. As shown in FIG. 2, this electrode layer 7 is divided into a common electrode 7*a* connected to all the plurality of heating elements 5*a* and a plurality of individual electrodes 7*b* connected individually to the plural respective heating elements 5*a*, with the opening portion 7*c* therebetween. A wiring Al electrode is disposed on each individual electrode 7*b*, and the width dimension of each individual electrode 7*b* is regulated by the gap regions a disposed between adjacent individual electrodes 7*b*. The electrode layer 7 is formed from a high-melting point metallic material, e.g., Cr, Ta, Mo, W, or Ti, (Cr in the present embodiment), and can also be compatible with a high-speed printing operation in which the heating element 5*a* is turned on (energization) or off (non-energization) by application of a large current at a short period on the order of a few hundred microseconds. The electrode layer 7 may be formed from Al or Cu, or be formed from an alloy material containing the above-described high-melting point metallic material or an alloy material containing Al or Cu.

In the thermal head having the above-described configuration, the Si substrate surface 1*a* is provided with an exposure region 10 including no first insulating layer 2 nor heat storage layer 3, and a contact portion 11 is disposed on the exposure region 10 to keep the common electrode 7*a* and the Si substrate surface 1*a* in ohmic contact. As described above, the Si substrate 1 has a resistivity reduced to 20 mΩ·cm or less, and has an area and a thickness larger than those of the common electrode 7*a*. Therefore, when the Si substrate 1 is electrically connected to the common electrode 7*a* via the above-described contact portion 11, the entire Si substrate 1 functions as a part of the common electrode 7*a*, and the resistance value of the common electrode 7*a* is significantly reduced. In this manner, the voltage drop (common drop) of the common electrode 7*a* is reduced, and the heating value of each heating element 5*a* is kept constant. That is, high-quality printing can be realized.

The contact portion 11 is disposed to come into contact with the exposure region 10 of the Si substrate surface 1*a* and an end portion of the common electrode 7*a* adjacent to the exposure region 10. In the present embodiment, the contact portion 11 is formed integrally with the common electrode 7*a*. However, the contact portion 11 may be disposed separately from the common electrode 7*a* while being in contact with or covering the end portion of the common electrode 7*a* on the side of the exposure region 10. Preferably, this contact portion 11 is formed from any one of high-melting point metals, e.g., Cr, Al, Ti, W, Mo, and Nb, and Cu or an alloy material primarily containing the high-melting point metal, e.g., Cr, Al, Ti, W, Mo, or Nb, or Cu in order to attain excellent adhesion to both the Si substrate 1 and the common electrode 7*a*. In the present embodiment, the Si substrate 1 is a p-type Si substrate doped with boron, and the common electrode 7*a* is made of Cr. Furthermore, since the contact portion 11 is formed integrally with the common electrode 7*a*, the contact portion 11 is made from Cr.

An embodiment of a method for manufacturing the thermal head shown in FIG. 1 and FIG. 2 will be described below with reference to FIG. 3 to FIG. 9.

Figure 3:
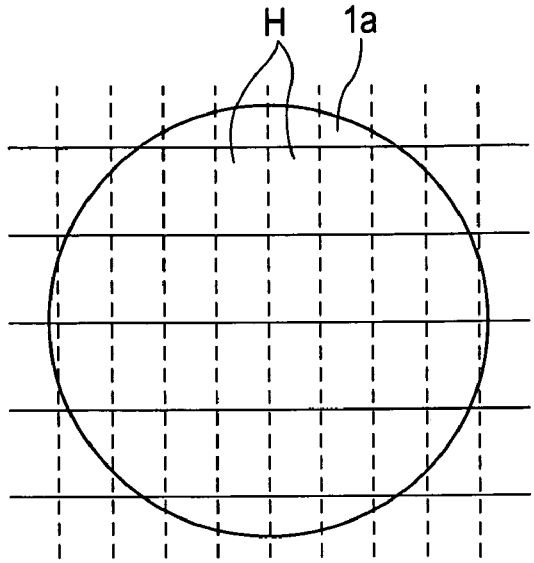
FIG. 3 is a sectional view showing one step of an embodiment of a method for manufacturing a thermal head according to the present invention.

A semiconductor Si substrate 1 having a resistivity of 20 mΩ·cm or less, preferably of 1.0 mΩ·cm or less, is prepared. In the present embodiment, a p-type Si substrate doped with about $10^{17}$ to $10^{19}$ per $cm^3$ of boron as an impurity is used. The thickness of the Si substrate 1 is about 1 mm. This Si substrate 1 is of either p-type or n-type, and preferably is selected appropriately in accordance with a material for forming the contact portion 11 and the common electrode 7*a* to be formed in the following step. The insulating film 13 made of $SiO_2$, for example, of about 1 μm in film thickness is formed all over the back 1*c* of the Si substrate. As shown in FIG. 3, the surface region of the Si substrate 1 is virtually divided to set parallel-arranged plural head-forming regions H.

The first insulating layer 2 and the heat storage layer 3 are sequentially formed by lamination all over the Si substrate surface 1*a*. The first insulating layer 2 is formed from an insulating material, e.g., $SiO_2$. The first insulating layer 2 is appropriately formed, if necessary, and may not be formed.

The heat storage layer 3 is formed from an oxide material containing Si, at least one selected from transition metals, and $O_2$ to have a film thickness of about 15 to 35 μm. Specifically, the heat storage layer 3 is formed by performing sputtering in an atmosphere of mixed gas of Ar and $O_2$ through the use of, for example, an alloy target of Si and Ta having a composition in which Si is 65 to 85 mole percent and Ta is 35 to 15 mole percent or an alloy target containing 65 to 85 mole percent of Si, 30 to 15 mole percent of Ta, and 20 to 0 mole percent of other transition metals, e.g., W. When the film is formed while the pressure of the sputtering gas is set at within the range of 0.8 to 1.6 Pa (pascal) and the $O_2$ gas flow rate is set at a value suitable for maximizing the sputtering rate (film formation rate) during this sputtering, the resulting heat storage layer 3 is a black oxide having a columnar property, a small thermal diffusivity, and excellent insulating property. The heat resistant temperature of the heat storage layer 3 produced in the present embodiment is about 1,000° C. At least one selected from Ta, Ti, Cr, Mn, Fe, Co, Ni, Cu, Y, Zr, Nb, Mo, La, Ce, Hf, and W is used alone or in appropriate combination as the transition metal constituting the heat storage layer 3. In particular, it is preferable that Ta, Mo, or W among them is used alone or in combination with other transition metals. Furthermore, the heat storage layer 3 having excellent characteristics can be formed through the use of a composition of multi-element system, e.g., Si—Ta—W—Mo—Fe—Ni or Si—Ta—W—Mo—Ti—Zr.

After the heat storage layer 3 is formed, a vacuum annealing treatment is performed at about 800° C. to 1,000° C., so that warp of the Si substrate 1 is corrected. Since the heat storage layer 3 is formed to have a large thickness of about 15 to 35 μm, significant warp may occur in the Si substrate 1 due to the compressive stress of the film in a usual case. On the other hand, in the present embodiment, the heat storage layer 3 is formed to have a columnar property, and the heat storage layer 3 itself is made to become dense by the above-described vacuum annealing. Consequently, the compressive stress in the inside of the film is reduced and, thereby, occurrence of warp in the Si substrate 1 can be significantly reduced. Specifically, warp can be reduced to within 0.1 mm in a substrate 3 inches square, for example. Since thermal hysteresis is provided beforehand to the heat storage layer 3 by the above-described vacuum annealing treatment, the reliability in the heat resistance of the heat storage layer 3 itself can be increased.

Figure 4:
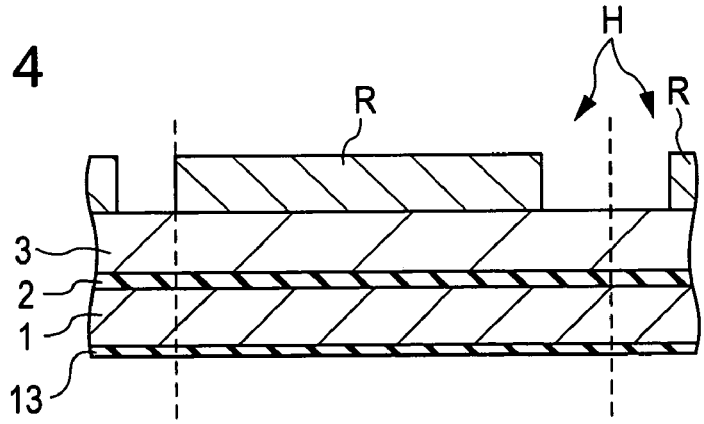
FIG. 4 is a sectional view showing a step following the step shown in FIG. 3.

Subsequently, as shown in FIG. 4, a resist layer R having a uniform film thickness to provide a height difference from the heat storage layer 3 is formed on a part of the heat storage layer 3 in each head forming region H. The resist layer R is to determine the sectional shape of the heat storage layer 3, and in a formation stage, the sectional shape thereof is a rectangle having edge portions substantially perpendicular to the surface of the heat storage layer 3. After the resist layer R is formed, a heat treatment (resist bake) is performed, so that the sectional shape of the resist layer R, in particular the sectional shape of the edge portions of the resist layer R are set.

Figure 5:
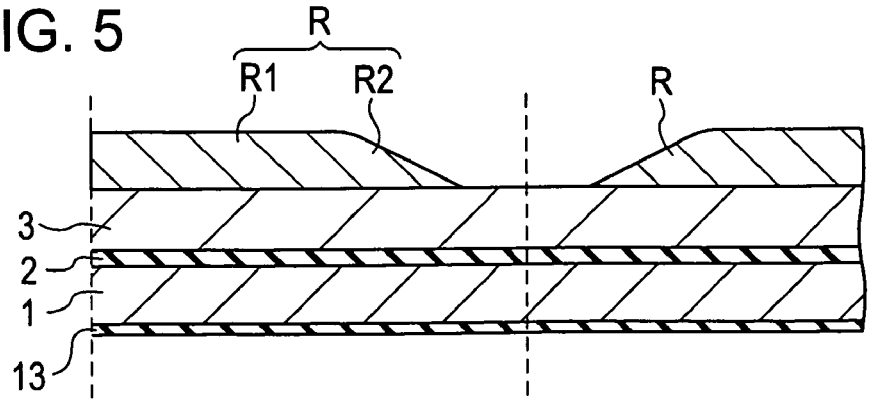
FIG. 5 is a sectional view showing a step following the step shown in FIG. 4.

The sectional shape of the resist layer R can be set at a predetermined shape by controlling at least one of the resist bake time, the resist bake temperature, and the film thickness in the formation of the resist layer R. Alternatively, it is possible to set at a predetermined shape by controlling the amount of light applied to the resist layer R by using a gray-scale mask during exposure of the resist. As shown in FIG. 5, a specific sectional shape of the resist layer R is made to be a convex shape including a uniform film thickness portion R1 to provide a height difference from the heat storage layer 3 and a taper edge portion R2 having a film thickness gradually increasing from the surface of the heat storage layer 3 toward the uniform film thickness portion R1. With respect to the resist layer R after being heat-treated, the top of the taper edge portion R2 is protruded although by a slight amount and, therefore, the height from the substrate surface becomes higher than the uniform film thickness portion R1.

Figure 6:
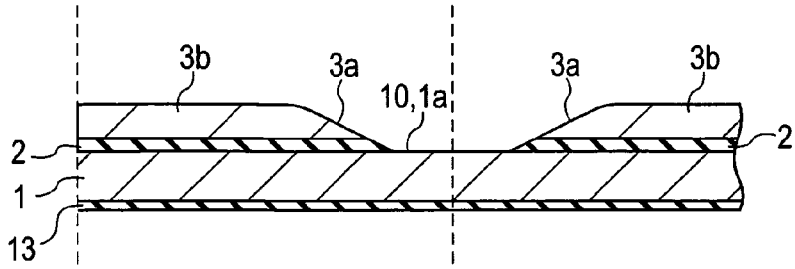
FIG. 6 is a sectional view showing a step following the step shown in FIG. 5.

After the sectional shape of the resist layer R is determined, a dry etching treatment is performed. In the dry etching treatment, the resist layers R, the heat storage layer 3, and the first insulating layer 2 are cut by ion milling, ion etching, or the like, from a plurality of different directions, so that the resist layers R are removed completely. At this time, the selection ratio (etching rate ratio) of the resist layer R to the heat storage layer 3 is controlled at 0.8 or more and 1.2 or less. In this range, when the resist layers R are removed completely, the sectional shape of the heat storage layer 3 becomes in accordance with the sectional shape of the resist R determined in the upstream step. That is, when the above-described selection ratio is 0.8 or more and 1.2 or less except 1, the sectional shape of the heat storage layer 3 becomes similar to that of the resist layer R, and when the selection ratio is 1, the sectional shape of the heat storage layer 3 becomes substantially the same as that of the resist layer R. After this dry etching step is completed, as shown in FIG. 6, the exposure region 10 is formed on a part of the Si substrate surface 1*a*, from which the heat storage layer 3 and the first insulating layer 2 are removed completely and at which the Si substrate surface 1*a* is exposed. The sectional shapes of the first insulating layer and the heat storage layer 3 adjacent to this exposure region 10 become into convex shapes including a uniform film thickness portion 3*b* to provide a height difference on the Si substrate surface 1*a* and a taper edge portion 3*a* having a film thickness gradually increasing from the side of the Si substrate surface 1*a* toward the uniform film thickness portion 3*b*. The top position of the taper edge portion 3*a* is protruded although by a slight amount and, therefore, the height from the substrate surface 1*a* is higher than the uniform film thickness portion 3*b*.

Figure 7:
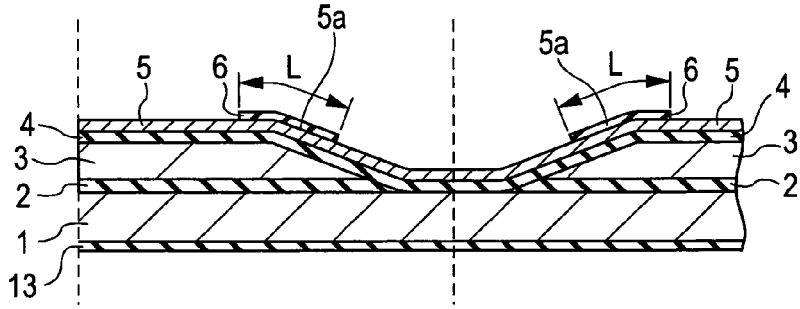
FIG. 7 is a sectional view showing a step following the step shown in FIG. 6.

As shown in FIG. 7, the second insulating layer 4 and the resistance layer 5 are formed successively on the Si substrate surface 1*a* (exposure region 10) and the heat storage layer 3. A sputtering method or an evaporation method can be used for the film formation. The second insulating layer 4 is formed from $SiO_2$, and the resistance layer 5 is formed from a cermet material, e.g., $Ta_2N$ or Ta—$SiO_2$. The second insulating layer 4 is appropriately formed, if necessary, and may not be formed.

As shown in FIG. 7, the insulating barrier layer 6 having a length dimension of L and having a film thickness of about 600 angstroms, for example, is formed on the resistance layer 5 while being located at the position above the taper edge portion 3*a* of the heat storage layer 3. Preferably, the insulating barrier layer 6 is formed from a material which is an insulating material having oxidation resistance and which is applicable to reactive ion etching (RIE). Specifically, it is preferable that $SiO_2$, $Ta_2O_5$, SiN, $Si_3N_4$, SiON, AlSiO, SiAlON, or the like is used. The resistance layer 5 covered with these insulating barrier layers 6 becomes the plurality of heating element portions 5*a* having a dot resistance length of L in the future. The insulating barrier layer 6 can be formed by RIE or a lift-off method. When RIE is used, the insulating barrier layer 6 may be formed all over the resistance layer 5 by sputtering or the like, a resist layer to determine the length dimension L may be formed on the insulating barrier layer 6 and, thereafter, the insulating barrier layer 6 not covered with the resist layer may be removed by RIE. On the other hand, when the lift-off method is used, a resist layer including an opening portion having a length dimension of L may be formed on the resistance layer 5, the insulating barrier layer 6 may be formed thereon and, thereafter, the resist layer and the insulating barrier layer 6 on the resist layer may be lifted off.

After the insulating barrier layer 6 is formed, an annealing treatment is performed. This annealing treatment is performed to reduce the rate of change in resistance of the heating element 5*a* after the use of the head is started, and is an acceleration treatment in which the resistance layer 5 is stabilized by application of a large thermal load. After the annealing treatment, in order to improve the adhesion between the electrode layer 7 formed in a following step and the resistance layer 5, ion beam etching or reverse sputtering is performed and, thereby, a surface oxidized layer of the resistance layer 5 is removed.

Subsequently, the resistance layer 5 and the second insulating layer 4 located on the exposure region 10 (Si substrate surface 1*a*) are removed by a photolithography technology (or RIE). Through this step, the exposure region 10 of the Si substrate 1 is exposed again, the exposure region 10 having been formed in the dry etching step to determine the sectional shape of the heat storage layer 3.

Figure 8A:
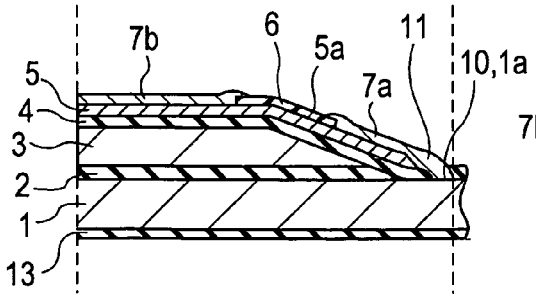
FIGS. 8A and 8B are a sectional view and a plan view, respectively, showing a step following the step shown in FIG. 7.
Figure 8B:
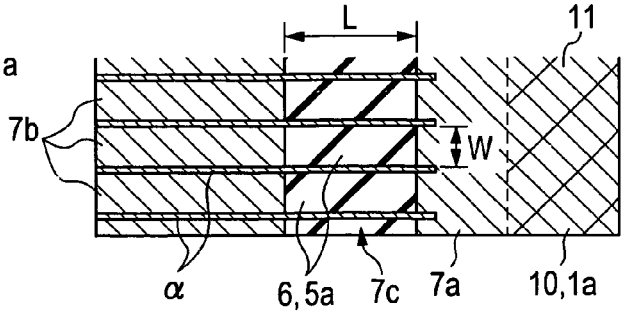
Figure 9:
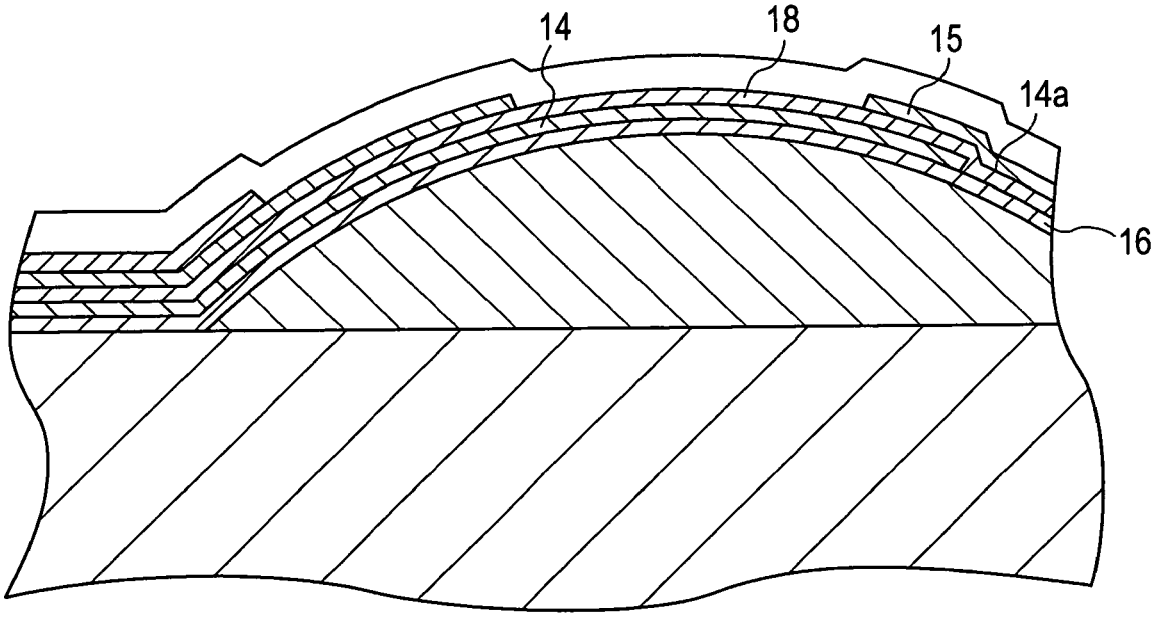
FIG. 9 PRIOR ART
FIG. 9 is a sectional view showing a known thermal head structure including a common electrode having a two-layer structure composed of upper and lower layers.

The electrode layer 7 made of a high-melting point metallic material (Cr in the present embodiment) is formed on the resistance layer 5, the insulating barrier layer 6, and the exposure region 10 of the Si substrate 1. The sputtering method or the evaporation method is used for the film formation. After the film formation, the photolithography technology is used and, thereby, unnecessary portions of the electrode layer 7, the insulating barrier layer 6, the resistance layer 5, the second insulating layer 4, the heat storage layer 3, and the first insulating layer 2 are removed. Consequently, as shown in FIGS. 8A and 8B, the pattern shape (width dimension W) of the electrode layer 7 is determined and, in addition, an opening portion 7*c* to expose the surface of the insulating barrier layer 6 is formed. By performing this step, the electrode layer 7 is separated into the individual electrode layer 7*b* located on the resistance layer 5 and the integrated common electrode 7*a* and the contact portion 11 located on the resistance layer 5 and the exposure region 10 of the Si substrate 1, with the opening portion 7*c* therebetween. In the present embodiment, the common electrode 7*a* and the contact portion 11 are formed simultaneously and integrally by the electrode layer 7 made of Cr. However, when the common electrode 7*a* and the contact portion 11 are formed from different materials, after the common electrode 7*a* is formed, the contact portion 11 is formed on the exposure region 10 of the Si substrate surface 1*a* by using the lift-off method or the like while the contact portion 11 is in contact with or is overlaid on the end portion of the common electrode 7*a* adjacent to the exposure region 10. The contact portion 11 is formed from any one of Cr, Al, Ti, W. Mo, Nb, and Cu or an alloy material primarily containing Cr, Al, Ti, W, Mo, Nb, or Cu in order to excellently adhere to both the Si substrate 1 and the common electrode 7*a*. The Si substrate surface 1*a* and the common electrode 7*a* are in ohmic contact through this contact portion 11, and the Si substrate 1 is constructed as a part of the common electrode 7*a*. On the other hand, the individual electrode 7*b* separated by the above-described opening portion 7*c* is fragmented by the gap regions a into a plurality of individual electrodes 7*b*. The first insulating layer 2 is exposed at the gap regions α. The individual electrodes 7*b* correspond to the plurality of heating elements 5*a*, and one individual electrode 7*b* is connected to one end-portion of the corresponding heating element 5*a*. The resistance layer 5 exposed at the opening portion 7*c* is divided by the gap regions a into a plurality of heating elements 5*a*. With respect to the above-described plurality of heating elements 5*a*, the length dimension (dot length) is specified to be L by the length dimension L of the insulating barrier layer 6, and the width dimension (dot width) is specified to be W by the gap regions a. As shown in FIG. 8B, the plurality of heating elements 5*a* and insulating barrier layers 6 are arranged having infinitesimal spacing in a direction perpendicular to the drawing, FIG. 8A. In the present embodiment, both end portions of the electrode layer 7 on the side of insulating barrier layer 6 are overlaid on the insulating barrier layer 6.

Wiring Al electrodes 8 are disposed on the plurality of individual electrodes 7*b*. After the Al electrodes 8 are formed, fresh film surfaces of the insulating barrier layer 6, the electrode layer 7, the Al electrodes 8, and the contact portion 11 are exposed by ion beam etching or reverse sputtering, so that the adhesion to the abrasion-resistant protective layer formed in a following step is ensured. Subsequently, the abrasion-resistant protective layer 9 made of an abrasion-resistant material, e.g., SiAlON or $Ta_2O_5$, is formed on the insulating barrier layer 6, the electrode layer 7, the Al electrodes 8, and the contact portion 11 with fresh film surfaces exposed. Through the steps up to this point, a structure composed of parallel-arranged plural thermal heads can be attained on the Si substrate 1.

The Si substrate 1 is cut into individual head-forming regions H, and an insulating film 12 is formed on each cut surface of the Si substrate 1 resulting from the cutting, that is, each side end surface of the Si substrate 1. The insulating film 12 may be formed from Si anodic oxidation film produced by anodic oxidization of the Si substrate 1. Alternatively, the insulating film 12 may be formed from a sputtering film made of an insulating material, e.g., $Si_2$, SiAlON, or SiON. An acceptable film thickness of the insulating film 12 is about 0.1 mm. In this manner, the thermal head shown in FIG. 1 and FIG. 2 is attained.

As described above, in the present embodiment, the Si substrate having a resistivity of 20 mΩ·cm or less is used and, in addition, the contact portion 11 is provided on the exposure region 10 disposed on the Si substrate surface 1*a*, so as to keep the Si substrate surface 1*a* and the common electrode 7*a* in ohmic contact. Consequently, the Si substrate 1 and the common electrode 7*a* can be electrically connected reliably and occurrence of short circuit between layers can be prevented by the simple structure and manufacturing process. Furthermore, since the Si substrate 1 constitutes a part of the common electrode 7*a*, the common resistance is reduced without increasing the area and the thickness of the common electrode, the common drop is excellently reduced and, thereby, the printing quality is improved.

In the above-described embodiment, the heat storage layer 3 is formed from the oxide material. However, the heat storage layer 3 may be formed by screen printing through the use of a highly insulating material, e.g., glass.

What is claimed is:

1. A thermal head comprising a heat storage layer disposed on a substrate surface by lamination, a plurality of heating elements disposed on the heat storage layer, a plurality of individual electrodes, each electrically connected individually to one end-portion of a heating element in a length direction of resistance, and a common electrode electrically connected to an opposing end-portions of all heating elements in the length direction of the resistance, wherein the substrate is a Si substrate having a resistivity of 20 mΩ·cm or less, and wherein the Si substrate is provided with an exposure region including no heat storage layer, and a contact portion is disposed on the exposure region, so as to keep the common electrode and the Si substrate surface in ohmic contact.

2. The thermal head according to claim 1, wherein the resistivity of the Si substrate is 1.0 mΩ·cm or less.

3. The thermal head according to claim 1, wherein the Si substrate is a p-type Si substrate doped with impurities.

4. The thermal head according to claim 3, wherein the contact portion comprises any one of Cr, Al, Ti, W, Mo, Nb, and Cu or an alloy material primarily containing Cr, Al, Ti, W, Mo, Nb, or Cu.

5. The thermal head according to claim 1, wherein insulating films are disposed on a back of the Si substrate and a circumferential end surface of the Si substrate in a thickness direction.

6. The thermal head according to claim 5, wherein an insulating film produced by anodic oxidation of the Si substrate is disposed on the circumferential end surface of the Si substrate in the thickness direction.

7. The thermal head according to claim 1, comprising insulating films on and under the heat storage layer.

8. The thermal head according to claim 1, wherein the heat storage layer includes a uniform film thickness portion to provide a height difference on the Si substrate surface and a taper edge portion having a film thickness gradually increasing from the Si substrate surface toward the uniform film thickness portion, and the common electrode is located above the taper edge portion.

9. A method for manufacturing a thermal head, the method comprising the steps of:

preparing a Si substrate having a resistivity of 20 mΩ·cm or less;

forming a heat storage layer all over the Si substrate surface;

removing a part of the heat storage layer disposed on the Si substrate to form an exposure region and to determine a sectional shape of the heat storage layer adjacent to the exposure region;

forming a plurality of heating elements, a common electrode connected commonly to one end-portion of each of the plural heating elements in a length direction of resistance, and a plurality of individual electrodes, each connected individually to an opposing end-portion of one of the heating elements in the length direction of the resistance, on the heat storage layer; and forming a contact portion on the exposure region, while the contact portion is in contact with an end portion of the common electrode on an exposure region side, so as to keep the common electrode and the Si substrate surface in ohmic contact.

10. The method for manufacturing a thermal head according to claim 9, the method comprising the step of forming insulating films on a back of the Si substrate and a circumferential end surface of the Si substrate in a thickness direction.

11. The method for manufacturing a thermal head according to claim 10, the method comprising the step of forming an insulating film on the circumferential end surface of the Si substrate in the thickness direction by Si anodic oxidization.

12. The method for manufacturing a thermal head according to claim 11, the method comprising the steps of virtually dividing the Si substrate surface to set parallel-arranged plural head-forming regions, forming each of the layers from the heat storage layer to the contact portion on a head-forming region basis, cutting the Si substrate into individual head-forming regions, and forming an insulating film on each cut surface of the Si substrate by anodic oxidation.

13. The method for manufacturing a thermal head according to claim 9, the method comprising the steps of forming a resist layer having a uniform film thickness on a part of the heat storage layer to provide a height difference from the heat storage layer, determining a sectional shape of the resist layer by resist bake, removing the resist layer and the heat storage layer by dry etching until the resist layer is completely removed, so as to set the sectional shape of the heat storage layer at a sectional shape corresponding to the sectional shape of the resist layer determined by the resist bake.

14. The method for manufacturing a thermal head according to claim 13, wherein the heat storage layer is formed on the Si substrate as a convex portion including a uniform film thickness portion to provide a height difference from the Si substrate surface and a taper edge portion having a film thickness gradually increasing from the Si substrate surface toward the uniform film thickness portion, and the common electrode is located above the taper edge portion.

* * * * *